US006823621B2

(12) United States Patent
Gotfried

(10) Patent No.: US 6,823,621 B2
(45) Date of Patent: Nov. 30, 2004

(54) INTELLIGENT WEAPON

(76) Inventor: Bradley L. Gotfried, 8949 SE. Bridge Rd., Hobe Sound, FL (US) 33455

( * ) Notice: Subject to any disclaimer, the term of this patent is extended or adjusted under 35 U.S.C. 154(b) by 0 days.

(21) Appl. No.: 10/305,918

(22) Filed: Nov. 26, 2002

(65) Prior Publication Data

US 2004/0099134 A1 May 27, 2004

(51) Int. Cl.[7] ..... F41A 17/46
(52) U.S. Cl. ..... 42/70.06; 42/70.01
(58) Field of Search ..... 42/70.01, 70.04, 42/70.05, 70.06, 70.08, 70.11, 70.1

(56) References Cited

U.S. PATENT DOCUMENTS

| | | | | |
|---|---|---|---|---|
| 5,587,904 A | * | 12/1996 | Ben-Yair et al. | 434/14 |
| 5,781,108 A | | 7/1998 | Jacob et al. | 340/552 |
| 5,807,109 A | | 9/1998 | Tzidon et al. | 434/35 |
| 5,937,563 A | * | 8/1999 | Schuetz et al. | 42/106 |
| 5,941,708 A | | 8/1999 | FitzGerald | 434/16 |
| 6,028,514 A | | 2/2000 | Lemelson et al. | 340/539 |
| 6,037,899 A | | 3/2000 | Weber | 342/357.06 |
| 6,201,495 B1 | | 3/2001 | Lemelson et al. | 342/45 |
| 6,220,168 B1 | | 4/2001 | Woodall et al. | 102/411 |
| 6,223,461 B1 | * | 5/2001 | Mardirossian | 42/70.11 |
| 6,226,913 B1 | * | 5/2001 | Haimovich et al. | 42/1.01 |
| 6,237,496 B1 | | 5/2001 | Abbott | 102/384 |
| 6,281,792 B1 | | 8/2001 | Lerg et al. | 340/540 |
| 6,283,756 B1 | | 9/2001 | Danckwerth et al. | 434/11 |
| 6,314,671 B1 | * | 11/2001 | Gering | 42/70.11 |
| 6,343,140 B1 | * | 1/2002 | Brooks | 42/70.01 |
| 6,385,894 B1 | * | 5/2002 | Podvin | 42/146 |
| 6,415,542 B1 | * | 7/2002 | Bates et al. | 42/70.11 |
| 6,428,769 B1 | * | 8/2002 | Rubsamen et al. | 340/5.33 |
| 2001/0029011 A1 | | 10/2001 | Dagani et al. | 434/11 |
| 2001/0052847 A1 | | 12/2001 | Auerbach | 340/540 |
| 2002/0003470 A1 | | 1/2002 | Auerbach | 340/425.5 |
| 2002/0008619 A1 | | 1/2002 | Lerg et al. | 340/540 |

FOREIGN PATENT DOCUMENTS

DE 34 46 019 A1 * 6/1986

OTHER PUBLICATIONS

U.S. Statutory Invention Registration, "Hostile Weapon Locator System," H1,916, Hollander, Nov. 7, 2000.
U.S. Statutory Invention Registration, "Portable Shipboard Gunnery Training/Diagnostic Apparatus," H613, Stello et al., Apr. 4, 1989.

* cited by examiner

*Primary Examiner*—Stephen M. Johnson
(74) *Attorney, Agent, or Firm*—Akerman Senterfitt

(57) ABSTRACT

A system for monitoring use of a weapon. The system includes a monitoring station and at least one weapon in which the weapon fires a projectile. The weapon includes a tracking device, in which the tracking device receives navigational data, and a transceiver. The transceiver transmits at least the navigational data to the monitoring station. The weapon can further include a biometric identifier for identifying a user and a trigger mechanism in which the biometric identifier can enable the trigger mechanism only when the biometric identifier identifies an authorized user. In one arrangement, the tracking device can be a global positioning system receiver that can receive navigational data from a plurality of global positioning system satellites.

32 Claims, 4 Drawing Sheets

INTELLIGENT WEAPON

CROSS REFERENCE TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

1. Technical Field

The present invention relates generally to weapons systems and more particularly, to the tracking of weapons.

2. Description of Related Art

Gun control has become an important issue in today's society. There are far too many instances in which deranged individuals wreak havoc by shooting innocent victims. Even more distressing, such shootings, particularly those done at random, are difficult to solve and strike fear into our nation's citizens. In response, several legislatures have enacted laws and regulations in an effort to prevent unauthorized persons from obtaining firearms.

For example, in 1993, the U.S. Congress passed and the President signed into law the Brady Handgun Violence Prevention Act. Commonly referred to as the Brady Bill, this legislation established a national system of background checks and waiting periods for individuals purchasing guns from federally licensed firearms dealers. Primarily designed to prevent convicted felons from obtaining guns and to provide purchasers with a "cooling off" period, the Brady Bill has been somewhat successful in preventing gun violence. Other initiatives have been advanced to further control access to firearms including requiring gun owners to place locks on their guns to eliminate accidental shootings.

Nevertheless, many proponents of gun control remain convinced that it is too easy to obtain a firearm in this country. As an example, these people argue that the Brady Bill has several loopholes in that it does not apply to gun shows and that nothing is in place to prevent guns from being purchased over the black market or simply stolen from a legal owner and later used to further criminal activity. Indeed, once a gun is acquired (illegally or even legally), presently there is no way to stop the weapon from being used or to monitor the weapon to help law enforcement officials solve any subsequent crimes committed by a person in possession of the firearm.

SUMMARY OF THE INVENTION

Figure 1:
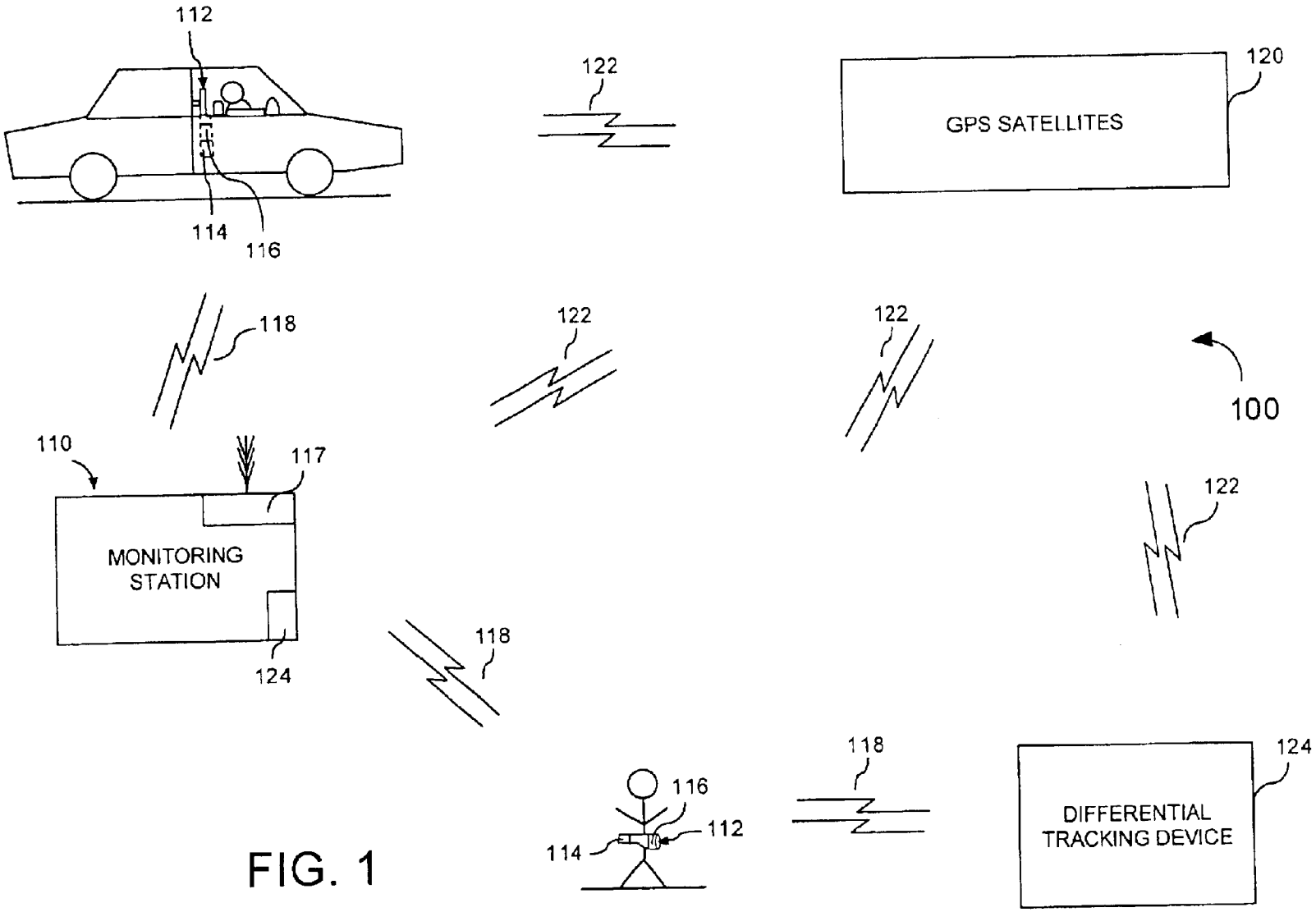
FIG. 1 illustrates a system for monitoring use of a weapon in accordance with the inventive arrangements.

The present invention concerns a system for monitoring use of a weapon. The weapon includes a monitoring station and at least one weapon in which the weapon fires a projectile and includes a tracking device that receives navigational. The weapon also has a transceiver that transmits at least the navigational data to the monitoring station. In one arrangement, the weapon can include a biometric identifier for identifying a user and a trigger mechanism in which the biometric identifier can enable the trigger mechanism only when the biometric identifier identifies an authorized user.

The tracking device can be a global positioning system receiver that can receive navigational data from a plurality of global positioning system satellites. As an example, the navigational data can include global positioning system coordinates in which the coordinates can include at least a latitude coordinate, a longitude coordinate and an altitude coordinate. In another arrangement, the transceiver can transmit identifying information to the monitoring station, and the identifying information can include at least one of a name, an address and a physical description of a user of the weapon.

The weapon can also have a trigger mechanism, and the transceiver can receive a disabling signal for disabling the trigger mechanism. The disabling signal can be selectively transmitted from the monitoring station. In one embodiment, the trigger mechanism can include a trigger, and the disabling signal can disable the trigger mechanism by causing the trigger to be immobilized. Additionally, the trigger mechanism can include a latch in which the latch can immobilize the trigger by selectively engaging the trigger.

In one aspect of the invention, the weapon can further contain a camera for producing at least one of an audio and a video segment. The camera can be activated when the weapon fires a projectile, and the transceiver can transmit at least one of the audio and video segments to the monitoring station. In another aspect, the weapon can have at least one sensor mechanism in which the sensor mechanism can detect when the weapon fires a projectile and can generate a signal containing data indicating that the weapon has fired a projectile and when the weapon fired the projectile. The transceiver can transmit this signal to the monitoring station, and the at least one sensor mechanism can include a sonic sensor. The weapon can further have a trigger mechanism having a trigger, and the at least one sensor mechanism can be electrically coupled to the trigger and the sensor mechanism can generates the signal when the trigger is pulled.

In another arrangement, the biometric identifier can be a fingerprint verification device having a memory for storing digitized fingerprint images. The fingerprint verification device can generate digitized images of fingerprints and can compare the generated images with the fingerprint images stored in the memory to authorize use of the weapon. Moreover, the fingerprint verification device can have at least one fingerprint scanner on a handle of the weapon. The trigger mechanism can have a trigger and a latch selectively engageable with the trigger, and the biometric identifier can cause the latch to disengage the trigger when the biometric identifier identifies the authorized user. In another aspect, the weapon can include at least one sensor mechanism and a trigger mechanism in which the trigger mechanism can have a trigger and the sensor mechanism can have a pressure switch located on the trigger. The sensor mechanism can generate a signal when a user places a finger on the pressure switch on the trigger.

The present invention also concerns an intelligent weapon for firing a projectile. The weapon includes a tracking device in which the tracking device receives navigational data and a transceiver. The transceiver transmits at least the navigational data to a monitoring station. The intelligent weapon also contains several of the components listed above regarding the system for monitoring use of a weapon and interacts with one or more of the mechanisms described above as well.

DETAILED DESCRIPTION OF THE PREFERRED EMBODIMENTS

Referring to FIG. 1, a system 100 for monitoring use of a weapon is shown. The system 100 can include at least one monitoring station 110 and at least one weapon 112. As an example, the weapon 112 can be any device that can fire a projectile, such as a firearm. The weapon 112 can include a tracking device 114 that can receive navigational data and a transceiver 116 that can transmit at least the navigational data to the monitoring station 110. In one arrangement, the transceiver 116 can transmit such data to the monitoring station 110 over a wireless communications link 118. This wireless communications link 118 can be any suitable link for transmitting radio frequency (RF) signals from the transceiver 116 to the monitoring station 110 and vice-versa. For purposes of the invention, an RF signal can be any signal that can be wirelessly propagated through a suitable medium. The monitoring station 110 can also include a transceiver 117 for transmitting signals over the wireless communications link 118 to the transceiver 116 of the weapon 112.

In one arrangement, the tracking device 114 of the weapon 112 can be a global positioning system (GPS) receiver that can receive the navigational data from a plurality of GPS satellites 120. The GPS satellites 120 can communicate with the tracking device 114 of the weapon 112 over a satellite communications link 122, which can be any link suitable for broadcasting RF signals from the GPS satellites 120 to the tracking device 114. Of course, this satellite communications link 122 can also be used to transmit signals from the GPS satellites 120 to the monitoring station 110 and vice-versa or from the tracking device 114 to the GPS satellites 120.

The navigational data can include GPS coordinates such as a latitude coordinate, a longitude coordinate and an altitude coordinate. As noted earlier, the transceiver 116 of the weapon 112 can transmit this navigational data to the monitoring station 110, which can use these coordinates to track the location of the weapon 112. Those of ordinary skill in the art, however, will appreciate that any other device or system suitable for providing location information to the tracking device 114 of the weapon 112 and capable of being forwarded to the monitoring station 110 can be used with the system 100.

In one particular arrangement, the system 100 can employ differential GPS to produce more accurate readings. As is known in the art, differential GPS technology relies on a stationary GPS receiver with known GPS coordinates for correcting errors in the transmissions from GPS satellites to other stationary or mobile targets containing GPS tracking devices. As an example, a differential tracking device 124 can be built into the monitoring station 110 and can receive signals from the GPS satellites 120 over the satellite communications link 122. The differential tracking device 124, because its GPS coordinates have previously been accurately measured, can generate an error correction factor that can be used to error correct the transmissions from the GPS satellites 120. The error correction factor can be transmitted from the transceiver 117 of the monitoring station 110 to the transceiver 116 of the weapon 112 over the wireless communications link 118 to produce a more accurate reading of the GPS coordinates of the weapon 112.

It is understood, however, that the differential tracking device 124 is not limited to being positioned at the monitoring station 110, as any number of differential tracking devices 124 can be placed at other suitable locations (as also illustrated in FIG. 1). Moreover, the system 100 can be designed to rely on pre-existing differential tracking devices 124 constructed by, for example, a governmental agency. Nevertheless, the use of differential GPS is not a requirement of the invention; in fact, it must be stressed that the invention is not limited to tracking a weapon 112 through the use of GPS technology, as any other technique for locating the weapon 112 can be practiced with the invention.

Figure 2:
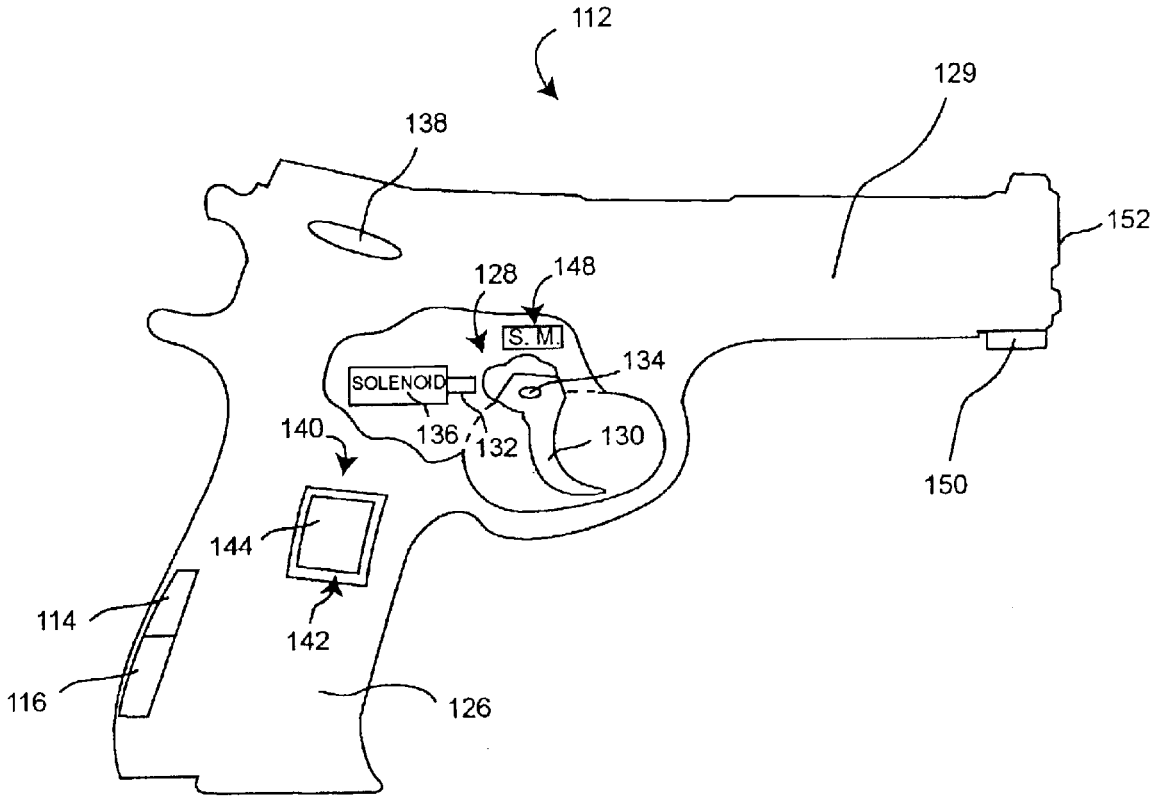
FIG. 2 illustrates a weapon in accordance with the inventive arrangements.

Referring to FIG. 2, an example of a weapon 112 for use with the system 100 is illustrated. As an example, the weapon 112 can be a semi-automatic pistol that can fire any suitable number of projectiles or bullets. It is understood, however, that this illustration is merely one example of a weapon in accordance with the inventive arrangements and should not be construed to limit the invention. For example, the weapon 112 can also be a "stun gun," a gun used to incapacitate persons through an electrical charge. In this example, the transmitted electrons can be considered projectiles. In one arrangement, the tracking device 114 and the transceiver 116 can be located in a handle 126 of the weapon 112; these components can also be positioned in other suitable locations on the weapon 112.

A portion of the weapon 112 is cut away to show a section of the weapon 112 typically covered by an outer shell 129 of the weapon 112. As shown, the weapon 112 can include a trigger mechanism 128. The trigger mechanism 128 can include a trigger 130 and a latch 132 that can selectively engage the trigger 130. For purposes of clarity, only a portion of the trigger 130 is illustrated. As an example, the latch 132 can have an elongated shape, and the trigger 130 can include a slot 134 that can receive at least a portion of the latch 132. In one arrangement, the latch 132 can be part of a solenoid 136 and can engage or disengage the trigger 130 through the slot 134 when the solenoid 136 receives a signal. Circumstances that would initiate a latch engaging or disengaging are discussed below.

If the latch 132 engages the trigger 130 through the slot 134, the latch 132 can immobilize the trigger 130, and a user will be unable to sufficiently pull the trigger 130 to cause the weapon 112 to fire a projectile. Conversely, if the latch 132 disengages the trigger 130 (by being removed from the slot 134), the trigger 130 is no longer immobilized, and the user would be free to fire the weapon 112. Those of ordinary skill in the art will appreciate that the above-described configuration is merely one example of how to selectively engage the weapon 112, as any other suitable mechanism can be used to do so. For example, the weapon 112 can include a safety lever 138, a component typically located on many firearms, in which the safety lever 138 can be selectively controlled through the use of the solenoid 136.

The weapon 112 can also include a biometric identifier 140. The biometric identifier 140 can be used to measure at least one biometric characteristic of a user. Implementing a biometric identifier 140 into the weapon 112 can prevent unauthorized use of the weapon 112. As an example, the biometric identifier 140 can be a fingerprint verification device 142 having at least one fingerprint scanner 144. In one particular embodiment and as shown in FIG. 2, the fingerprint scanner 144 can be located on the handle 126 of the weapon 112 to maximize convenience to the user. To easily accommodate right or left-handed users, a fingerprint scanner 144 can be placed on either side of the handle 126. Of course, the invention is not so limited, as the fingerprint scanner 144 can be located at any other suitable position on the weapon 112.

It is also important to note that the biometric identifier 140 is not limited to verifying a user's fingerprint. As such, the biometric identifier 140 can be a device that can analyze other suitable biometric measurements such as (but not limited to) a retinal scan, an iris scan or voice recognition. An example of a biometric identifier 140 in accordance with the inventive arrangements will be described below. In another arrangement, the weapon 112 can include at least one sensor mechanism 148. The sensor mechanism 148 can detect when the weapon 112 fires a projectile and can generate a signal containing data that indicates that the weapon 112 has fired such a projectile and at what time the projectile was fired. Examples of a sensor mechanism 148 in accordance with the inventive arrangements will be described below.

The weapon 112 can also include a camera 150 that can produce an audio segment, a video segment or a combination of the two. Although FIG. 2 illustrates the camera 150 as being disposed near the front of the weapon 112 below a barrel 152 of the weapon 112, the invention is not limited to this particular configuration, as the camera 150 can be positioned at any other suitable location on the weapon 112. In one embodiment, the camera 150 can be activated when the weapon 112 fires a projectile or when a user places his or her finger on the trigger 130, at which time the camera 150 can begin to produce segments of audio and/or video. The transceiver 116 of the weapon 112 can subsequently transmit these segments of audio and/or video to the monitoring station 110 (see FIG. 1).

Figure 3:
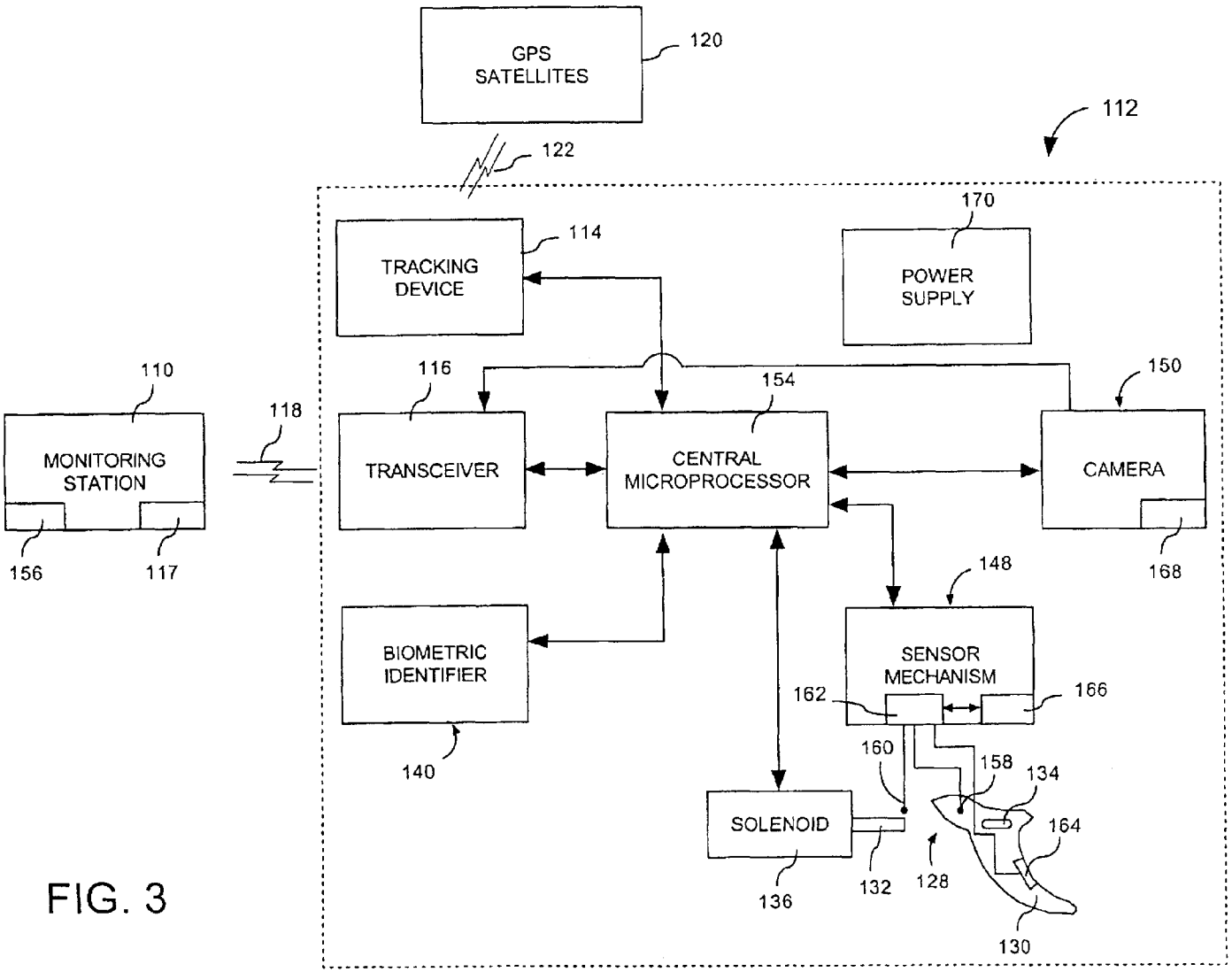
FIG. 3 illustrates a block diagram of several components of the weapon and system of FIGS. 1 and 2 in accordance with the inventive arrangements.

Referring to FIG. 3, a block diagram illustrating a number of the components of the weapon 112 (represented by the dashed outline) described in relation to FIGS. 1 and 2 is shown. In addition to each of the previously discussed elements, the weapon 112 can have a central microprocessor 154 for controlling the operation of the components of the weapon 112. Specifically, the weapon 112 can include control and data interfaces for permitting the central microprocessor 154 to control the operation of the tracking device 114, the transceiver 116, the biometric identifier 140, the solenoid 136, the sensor mechanism 148 and the camera 150. In addition, suitable software or firmware can be provided in memory for the conventional operations performed by the central microprocessor 154; program routines can also be provided for the central microprocessor 154 in accordance with the inventive arrangements.

As noted earlier, the tracking device 114 can receive navigational data from, for example, GPS satellites 120 over the satellite communications link 122 and can forward the navigational data to the central microprocessor 154. In accordance with GPS technology, the GPS satellites 120 can continuously update the navigational data, which can be particularly useful if the weapon 112 is in transit. The central microprocessor 154 can instruct the transceiver 116 to transmit this navigational data to the transceiver 117 of the monitoring station 110 over the wireless communications link 118. The monitoring station 110 can have at least one display 156 for displaying this navigational data thereby permitting an operator or a computer at the monitoring station 110 to track the whereabouts of the weapon 112.

As discussed earlier, the latch 132 may be engaged with the slot 134 of the trigger 130, which can immobilize the trigger 130. For convenience, only a portion of the trigger 130 of the trigger mechanism 128 is shown. Although FIG. 3 implements the trigger 130 as shown in FIG. 2, it is important to note that the term "trigger" is not limited to a conventional firearm trigger commonly found on many guns. The term "trigger" can include any device, component or circuit capable of causing a weapon to fire a projectile.

If an authorized user wishes to use the weapon 112, the user can provide a biometric sample, such as a fingerprint, to the biometric identifier 140. The biometric identifier 140 can analyze the biometric sample to determine whether the user is an authorized user. If the user is an authorized user, the biometric identifier 140 can signal the central microprocessor 154, which in turn can signal the solenoid 136. When activated, the solenoid 136 can cause the latch 132 to disengage the slot 134 of the trigger 130, which can permit the trigger 130 to be "pulled" for purposes of firing a projectile. Conversely, if the biometric identifier 140 does not recognize the provided biometric sample, no signal is forwarded to the solenoid 136, and the trigger 130 can remain immobilized.

The sensor mechanism 148 can determine whether and when the weapon 112 has fired a projectile. In one arrangement, the sensor mechanism 148 can include at least two electrical contacts 158, 160. Electrical contact 158 can be positioned on the trigger 130 of the weapon 112 and electrically coupled to a controller 162 of the sensor mechanism 148; electrical contact 160 can be positioned behind the electrical contact 158 and electrically coupled to the controller 162 as well. The controller 162 can have a clock (not shown) for generating time stamps.

If a user is authorized to use the weapon 112, i.e., the trigger 130 is not immobilized, when the trigger 130 is pulled far enough to fire a projectile, the electrical contact 158 on the trigger 130 can contact the electrical contact 160, which can, at least temporarily, create a closed circuit between the electrical contacts 158, 160, their electrical couplings and the controller 162. In response, the controller 162 can generate a signal containing data indicating that the weapon 112 has fired a projectile and can insert into this signal a time stamp from the clock indicating when the projectile was fired. The controller 162 can forward the signal to the central microprocessor 154, which can instruct the transceiver 116 to forward the information in the signal to the transceiver 117 of the monitoring station 110 over the wireless communications link 118. Similar to the navigational data, the information indicating that the weapon 112 has fired a projectile and the time that the projectile was fired can be displayed on the display 156 of the monitoring station 110.

The electrical contacts 158, 160, as shown in FIG. 3, can be spaced apart at a distance that would require a user to pull the trigger 130 far enough to fire a projectile to generate the signal to be forwarded to the central microprocessor 154. Nevertheless, the electrical contacts 158, 160 can be spaced apart at other suitable distances; specifically, this distance is not limited to a space expansive enough to cause the weapon 112 to discharge a projectile before a signal is generated by the closing of the circuit containing these contacts 158, 160.

In an alternative arrangement, the sensor mechanism 148 can include a pressure switch 164 positioned on the trigger 130 and electrically coupled to the controller 162. In one arrangement, the pressure switch 164 can be located on the trigger 130 such that a user's finger will contact the pressure switch 164 when the user places his or her finger on the trigger 130. The pressure switch 164 can detect this contact and can signal the controller 162 of the sensor mechanism 148. The controller 162 can signal the central microprocessor 154 and as an option, can attach to this signal a time stamp from its clock. The central microprocessor 154 can instruct the transceiver 116 to transmit this information to the transceiver 117 of the monitoring station 110 over the wireless communications link 118, and the information can be shown on the display 156. Thus, a party at the monitoring station 110 can be aware that a user in possession of the weapon 112 has placed his or her finger on the trigger 130 in preparation of possibly firing the weapon 112.

In addition to the previous two examples, the sensor mechanism 148 can also include a microphone 166 for detecting when the weapon 112 fires a projectile. The microphone 166 can capture the sound of the weapon 112 firing and can convert this sound into an electrical signal. The microphone 166 can forward this signal to the controller 162, which in turn can add to the signal a time stamp from its clock and can send the signal to the central microprocessor 154. As known in the art, the sensor mechanism 148 can include a filtering circuit (not shown) programmed to recognize the digital signature of the distinct sound that the weapon 112 produces when fired. Such a design can help eliminate false signals that may otherwise be misinterpreted as an indication that the weapon 112 has discharged a projectile.

Similar to the signals generated by the electrical contacts 158, 160 and the pressure switch 164, the central microprocessor 154 can instruct the transceiver 116 to transmit to the monitoring station 110 (over the wireless communications link 118) the information contained in the signal produced by the microphone 166. Those of ordinary skill in the art will appreciate that the sensor mechanism 148 is not necessarily limited to either of the above-described examples, as any other component capable of determining that the weapon 112 has fired a projectile (and optionally at what time the weapon was fired) can be implemented into the invention. Of course, the use of a sensor mechanism 148 is not required to practice the invention.

The camera 150 can produce segments of audio or video or a combination thereof. For purposes of the invention, the term "video" can include streaming video or a series of discrete photographs similar to those images produced by a digital camera. Thus, the camera 150 can be any camera capable of producing such video and because this technology is well known, a detailed explanation of this particular component is unnecessary. Nevertheless, it is important to note that the camera 150 can include a microphone 168 for capturing sound and converting the sound into electrical signals. It is also understood that the camera 150 can include a suitable encoding mechanism (not shown) for compressing any video and audio produced by the camera 150.

Once compressed, the video and/or audio can be fed to the transceiver 116, and the central microprocessor 154 can instruct the transceiver 116 to transmit the video and/or audio to the transceiver 117 of the monitoring station 110 over the wireless communications link 118. As those of ordinary skill in the art will appreciate, the transceiver 116 can contain suitable circuitry for permitting the transmission of the video and/or audio over the wireless communications link 118. Once received, the segments of video and/or audio can be shown or broadcast over the display 156 of the monitoring station 110. As such, an operator at the monitoring station 110 can view images and listen to sounds associated with the environment in which the weapon 112 currently sits or is being handled.

The invention envisions several different scenarios for activating the camera 150. For example, the camera 150 can be activated at all times such that the weapon 112 is constantly transmitting video and/or audio to the monitoring station 110. Alternatively, the central microprocessor 154 can be programmed to activate the camera 150 at predetermined intervals, which can permit an operator to check the status of the weapon 112 through the generated video/audio segments at such intervals. In another arrangement, an activation signal can be transmitted from the transceiver 117 of the monitoring station 110 to the transceiver 116 of the weapon 112 over the wireless communications link 118. Once it receives this signal, the transceiver 116 can signal the central microprocessor 154, which can subsequently signal, and thereby activate, the camera 150 to begin producing segments of video and/or audio. This activation signal transmitted from the monitoring station 110 can be sent at any time, and the transmission can even be in accordance with a predetermined interval.

The camera 150 can also be activated based on the signals generated by the sensor mechanism 148. For example, if the sensor mechanism 148 generates a signal based on the completion of the circuit including the electrical contacts 158, 160 when the trigger 130 is pulled, the central microprocessor 154 can signal the camera 150 to begin producing video and/or audio. In addition, the central microprocessor 154 can signal the camera 150 in response to the central microprocessor's 154 receipt of the signals created by the sensor mechanism 148 through the pressure switch 164 or the microphone 166. It is understood, however, that the invention is not limited to any of the above examples, as any other suitable mechanism for activating the camera 150 can be practiced with the invention.

In one arrangement, a disabling signal can be transmitted from the monitoring station 110 for remotely disabling the trigger mechanism 128. Specifically, the disabling signal can be sent from the transceiver 117 of the monitoring station 110 to the transceiver 116 of the weapon 112 over the wireless communications link 118. The signal can then be forwarded to the central microprocessor 154, which, in response, can signal the solenoid 136. This signal can energize the solenoid 136 thereby causing the latch 132 to engage the slot 134 of the trigger 130. As explained earlier, this process can immobilize the trigger 130 thereby disabling the trigger mechanism 128. If desired, the central microprocessor 154 can be programmed to grant this disabling signal with priority over any other signals processed by the central microprocessor 154.

The weapon 112 can also include a power supply 170. Although no connections are shown in FIG. 3 for purposes of convenience, the power supply 170 can supply power to the tracking device 114, the transceiver 116, the biometric identifier 140, the sensor mechanism 148, the camera 150, the central microprocessor 154 and any other components related to each of the above elements. In one arrangement, the power supply 170 can comprise a set of disposable or rechargeable batteries. Of course, any other suitable form of a portable power supply can be practiced with the invention. The weapon 112 can also include a power indicator light (not shown) that can inform a user that the power supply 170 needs to be replaced or recharged.

Figure 4:
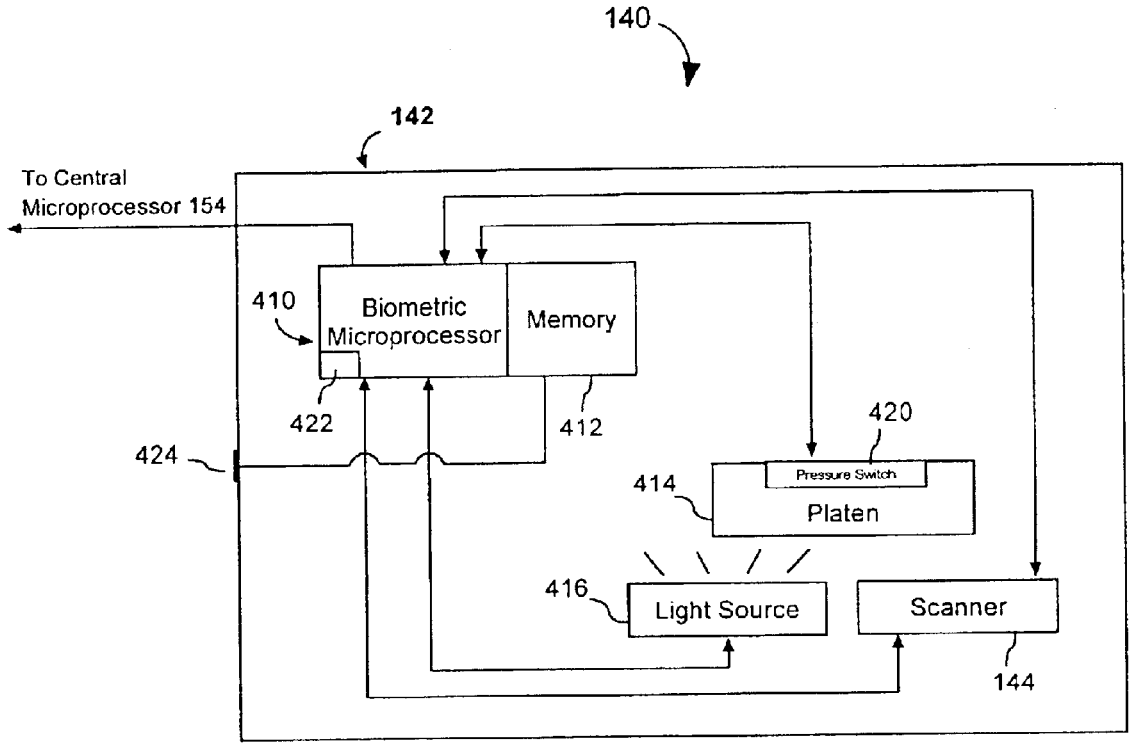
FIG. 4 illustrates an example of a biometric identifier in accordance with the inventive arrangements.

Referring to FIG. 4, one example of a biometric identifier 140 in accordance with the inventive arrangements is shown. In this example and as explained above, the biometric identifier 140 can be a fingerprint verification device 142, which can be loaded with authorized, digitized images of fingerprints, can generate digitized images of fingerprints and can compare the generated images with the stored, authorized images for purposes of enabling the trigger mechanism 128 (see FIG. 3). The fingerprint verification device 142 can include a biometric microprocessor 410 containing a memory 412, of which at least a portion can be non-volatile, a platen 414, a light source 416, a fingerprint scanner 144 (see FIG. 2 also) and a pressure switch 420. In addition, the biometric microprocessor 410 can include a timer 422.

The fingerprint verification device 142 can also include a port 424 coupled to the memory 412 of the biometric microprocessor 410. Through this port 424, digitized fingerprint images of authorized users can be uploaded into the memory 412 of the fingerprint verification device 142. As an example, fingerprint scanning devices can be located at law enforcement agencies or authorized firearms dealers, who can verify that the individual whose fingerprint images are being generated for storage is permitted to own a weapon. Of course, other suitable individuals, agencies or organizations can be used to create fingerprint images for storage in the memory 412 of the fingerprint verification device 142.

It is understood, however, that the invention is not so limited, as the fingerprint verification device 142 is not required to have a port for permitting the uploading of authorized fingerprint images. For example, the biometric microprocessor 410 can be programmed to initiate an authorizing step in which the fingerprint verification device 142 can permit a user to generate the authorized images himself or herself. Such a process would eliminate the need for any third parties to perform the authorization step, and the user could enter into the memory 412 any suitable number of approved fingerprint images.

The light source 416 can direct light towards the platen 414 and can be, for example, a light emitting diode. The platen 414 can also be transparent to the wavelength of the emitted light and can contain the pressure switch 420, which can be electrically coupled to the biometric microprocessor 410. The pressure switch 420 can detect when a user has placed his or her finger on the platen 414 and can signal the biometric microprocessor 410. In addition, the biometric microprocessor 410 can control the operation of the light source 416 and the fingerprint scanner 144. The fingerprint scanner 144 can be any biometric device capable of scanning fingerprint images and converting these images into digitized images.

In operation, a user can place his or her finger on the platen 414, and the pressure switch 420 can signal the biometric microprocessor 410. The biometric microprocessor 410 can signal the fingerprint scanner 144 and the light source 416, which can emit the light needed to create a scanned image of the user fingerprint. The light can pass through the platen 414 and can strike the user's finger, which can cause the light to be reflected to the fingerprint scanner 144.

From the reflected light, the fingerprint scanner 144 can generate a scanned image of the user's fingerprint and can convert the image into a digital signal. The fingerprint scanner 144 can forward this signal to the biometric microprocessor 410, which can compare this generated image with the digitized images stored in the memory 412. The biometric microprocessor 410 can signal the central microprocessor 154 (see FIG. 3) with the results of the comparison.

In particular, referring to FIGS. 3 and 4, if the newly generated fingerprint image matches an image stored in the memory 412, the biometric microprocessor 410 can signal the central microprocessor 154, which can signal the solenoid 136 to energize thereby causing the latch 132 to disengage the slot 134. As explained earlier, this process can enable the trigger mechanism 128 by permitting the trigger 130 to be pulled to fire the weapon 112. Conversely, if the generated image does not match an image stored in the memory 412, the biometric microprocessor 410 can signal the central microprocessor 154, which will not signal the solenoid 136 for purposes of enabling the trigger mechanism 128.

In another arrangement, as authorized fingerprint images are loaded into the memory 412, the central microprocessor 154 can be programmed with certain types of information related to the owner of the scanned fingerprint image. As an example, when a user has his or her fingerprint images scanned and loaded into the memory 412, the central microprocessor 154 can be programmed with identifying information relevant to that user. For instance, the information can include the user's name, address and physical description. In addition, a digitized photograph of the user, compressed with any suitable compression technique, can be transferred into the memory 412. It is understood, however, that the invention is not limited to these particular examples, as the central microprocessor 154 can be programmed with other suitable types of information concerning the user.

When the biometric microprocessor 410 determines that a scanned image matches an image stored in the memory 412, the biometric microprocessor 410 can signal the central microprocessor 154 with a coded signal that can instruct the central microprocessor 154 as to which authorized user(s) has provided a fingerprint image. In response, the central microprocessor 154 can access the identifying information relevant to the user and can instruct the transceiver 116 to transmit the information to the transceiver 117 of the monitoring station 110 over the wireless communications link 118. This identifying information can supplement the navigational data that is being transmitted to the monitoring station 110 or can be transmitted without the navigational data. When the identifying information is received at the monitoring station 110, this information can be shown on the display 156. As such, an operator at the monitoring station 110 can determine who has enabled the weapon 112 through the fingerprint verification device 142.

In another arrangement, the fingerprint verification device 142 can enable the trigger mechanism 128 for a limited time interval. For example, once the biometric microprocessor 410 determines that the user is an authorized user and signals the central microprocessor 154 to enable the trigger mechanism 128, the timer 422 can be used to limit the duration that the trigger mechanism 128 is enabled. Specifically, once the trigger mechanism 128 is enabled, the timer 422 can begin a countdown of a predetermined time interval. After the predetermined time interval is over, the timer 422 can signal the biometric microprocessor 410, which can initiate another authorization step. If the user has kept his or her finger on the platen 414 of the biometric identifier 140, another scanned image of the user's fingerprint can be created, and the biometric microprocessor 410 can once again compare this image to the stored images in the memory 412. If there is a match, the trigger mechanism 128 can remain enabled.

Conversely, if the user has removed his or her finger from the platen 414 of the fingerprint verification device 142 and the predetermined interval has timed out, no image can be created, and the biometric microprocessor 410 can signal the central microprocessor 154. The central microprocessor 154 can then signal the solenoid 136, which can cause the latch 132 to engage the slot of the trigger 130 and disable the trigger mechanism 128. This same principle can apply if an unauthorized user has acquired the weapon 112 and has placed his or her finger on the platen 414. The predetermined interval can be any suitable duration of time.

Although one example of a biometric identifier has been presented, it is important to note that the invention is in no way limited to this particular system. Those of ordinary skill in the art will appreciate that other systems suitable for measuring biometric characteristics can be used. Examples of other suitable systems include retinal or iris scanners or voice recognition systems. In fact, the invention does not require the use of a biometric identifier, as the weapon 112 and the system 100 (see FIG. 1) can operate without such a device.

Although the present invention has been described in conjunction with the embodiments disclosed herein, it should be understood that the foregoing description is intended to illustrate and not limit the scope of the invention as defined by the claims.

What is claimed is:

1. A system for monitoring use of a weapon, comprising:

a monitoring station; and at least one weapon, wherein said weapon fires a projectile;

said weapon including a tracking device, wherein said tracking device receives navigational data and a transceiver, wherein said transceiver transmits at least said navigational data to said monitoring station;

wherein said weapon further includes;

a biometric identifier for identifying a user; and a trigger mechanism;

wherein said biometric identifier enables said trigger mechanism only when said biometric identifier identifies an authorized user.

2. The system according to claim 1, wherein said tracking device is a global positioning system receiver that receives navigational data from a plurality of global positioning system satellites.

3. The system according to claim 1, wherein said navigational data comprises global positioning system coordinates, wherein said coordinates include at least a latitude coordinate, a longitude coordinate and an altitude coordinate.

4. The system according to claim 1, wherein said weapon further comprises a trigger mechanism;

wherein said transceiver receives a disabling signal for disabling said trigger mechanism;

wherein said disabling signal is selectively transmitted from said monitoring station.

5. The system according to claim 4, wherein said trigger mechanism includes a trigger, wherein said disabling signal disables said trigger mechanism by causing said trigger to be immobilized.

6. The system according to claim 5, wherein said trigger mechanism includes a latch;

wherein said latch immobilizes said trigger by selectively engaging said trigger.

7. The system according to claim 1, wherein said weapon further comprises a camera for producing at least one of an audio and a video segment;

wherein said camera is activated when said weapon fires a projectile;

wherein said transceiver transmits at least one of said audio and video segments to said monitoring station.

8. The system according to claim 1, wherein said weapon further comprises at least one sensor mechanism;

wherein said sensor mechanism detects when said weapon fires a projectile and generates a signal containing data indicating that said weapon has fired a projectile and when said weapon fired the projectile.

9. The system according to claim 8, wherein said transceiver transmits said signal to said monitoring station.

10. The system according to claim 8, wherein said at least one sensor mechanism comprises a sonic sensor.

11. The system according to claim 8, wherein said weapon further comprises a trigger mechanism having a trigger;

wherein said at least one sensor mechanism is electrically coupled to said trigger and said sensor mechanism generates said signal when said trigger is pulled.

12. The system according to claim 1, wherein said biometric identifier is a fingerprint verification device having a memory for storing digitized fingerprint images;

wherein said fingerprint verification device generates digitized images of fingerprints and compares the generated images with the fingerprint images stored in said memory to authorize use of said weapon.

13. The system according to claim 12, wherein said fingerprint verification device comprises at least one fingerprint scanner on a handle of said weapon.

14. The system according to claim 1, wherein said trigger mechanism has a trigger and a latch selectively engageable with said trigger;

wherein said biometric identifier causes said latch to disengage said trigger when said biometric identifier identifies the authorized user.

15. The system according to claim 1, wherein said weapon further comprises at least one sensor mechanism and a trigger mechanism;

wherein said trigger mechanism has a trigger and said sensor mechanism has a pressure switch located on said trigger;

wherein said sensor mechanism generates a signal when a user places a finger on said pressure switch on said trigger.

16. A system for monitoring use of a weapon, comprising:

a monitoring station; and at least one weapon, wherein said weapon fires a projectile;

said weapon including a tracking device, wherein said tracking device receives navigational data and a transceiver, wherein said transceiver transmits at least said navigational data to said monitoring station;

wherein said transceiver transmits identifying information to said monitoring station;

wherein said identifying information includes at least one of a name, an address and a physical description of a user of said weapon.

17. An intelligent weapon for firing a projectile, comprising:

a tracking device, wherein said tracking device receives navigational data;

a transceiver, wherein said transceiver transmits at least the navigational data to a monitoring station;

a biometric identifier for identifying a user; and a trigger mechanism;

wherein said biometric identifier enables said trigger mechanism only when said biometric identifier identifies an authorized user.

18. The weapon according to claim 7, wherein said tracking device is a global positioning system receiver that receives navigational data from a plurality of global positioning system satellites.

19. The weapon according to claim 17, wherein the navigational data comprises global positioning system coordinates, wherein said coordinates includes at least a latitude coordinate, a longitude coordinate and an altitude coordinate.

20. The weapon according to claim 17, further comprising a trigger mechanism;

wherein said transceiver receives a disabling signal for disabling said trigger mechanism;

wherein the disabling signal is selectively transmitted from the monitoring station.

21. The weapon according to claim 20, wherein said trigger mechanism includes a trigger;

wherein the disabling signal disables said trigger mechanism by causing said trigger to be immobilized.

22. The weapon according to claim 21, wherein said trigger mechanism includes a latch;

wherein said latch immobilizes said trigger by selectively engaging said trigger.

23. The weapon according to claim 17, further comprising a camera for producing at least one of an audio segment and a video segment;

wherein said camera is activated when said weapon fires a projectile;

wherein said transceiver transmits at least one of the audio and video segments to the monitoring station.

24. The weapon according to claim 17, farther comprising at least one sensor mechanism;

wherein said sensor mechanism detects when said weapon fires a projectile and generates a signal containing data indicating that said weapon has fired a projectile and when said weapon fired the projectile.

25. The weapon according to claim 24, wherein said transceiver transmits the signal to the monitoring station.

26. The weapon according to claim 24, wherein said at least one sensor mechanism comprises a sonic senior.

27. The weapon according to claim 24, further comprising a trigger mechanism having a trigger;

wherein said at least one sensor mechanism is electrically coupled to said trigger and said sensor mechanism generating the signal when said trigger is pulled.

28. The weapon according to claim 17, wherein said biometric identifier is a fingerprint verification device having a memory for storing digitized fingerprint images;

wherein said fingerprint verification device generates digitized images of fingerprints and compares the generated images with the fingerprint images stored in said memory to authorize use of said weapon.

29. The weapon according to claim 28, wherein said fingerprint verification device comprises ax least one fingerprint scanner on a handle of said weapon.

30. The weapon according to claim 17, wherein said trigger mechanism has a trigger and a latch selectively engageable with said trigger;

wherein said biometric identifier causes said latch to disengage said trigger when said biometric identifier identifies the authorized user.

31. The weapon according to claim 17, further comprising at least one sensor mechanism and a trigger mechanism;

wherein said trigger mechanism has a trigger and said sensor mechanism has a pressure switch located on said trigger;

wherein said sensor mechanism generates a signal when a user places a finger on said pressure switch on said trigger.

32. An intelligent weapon for firing a projectile, comprising:

a tracking device, wherein said tracking device receives navigational data;

a transceiver, wherein said transceiver transmits at least the navigational data to a monitoring station;

wherein said transceiver transmits identifying information to the monitoring station;

wherein the identifying information includes at least one of a name, an address and a physical description of a user of said weapon.

* * * * *